United States Patent [19]

Zaruba et al.

[11] Patent Number: 4,594,071

[45] Date of Patent: Jun. 10, 1986

[54] COMPOSITE TOY VEHICLE ASSEMBLY

[75] Inventors: John V. Zaruba; Patrick S. Baran, both of Chicago; Terry E. Webb, West Chicago; Harry Disko, South Barrington, all of Ill.

[73] Assignee: Marvin Glass & Associates, Chicago, Ill.

[21] Appl. No.: 699,831

[22] Filed: Feb. 8, 1985

[51] Int. Cl.[4] ..... A63H 3/16

[52] U.S. Cl. ..... 446/99; 446/101; 446/376; 446/487; 446/395

[58] Field of Search ..... 446/97, 99, 101, 93–95, 446/376, 487, 491, 395

[56] References Cited

U.S. PATENT DOCUMENTS

| | | | |
|---|---|---|---|
| 1,431,482 | 10/1922 | Overholt | 446/101 |
| 4,170,840 | 10/1979 | Ogawa | 446/95 |
| 4,183,173 | 1/1980 | Ogawa | 446/94 |
| 4,202,134 | 5/1980 | Morrison | 446/101 |
| 4,206,564 | 6/1980 | Ogawa | 446/94 |
| 4,391,060 | 7/1983 | Nakane | 446/94 |

*Primary Examiner*—Mickey Yu

*Attorney, Agent, or Firm*—John S. Pacocha

[57] ABSTRACT

A composite toy robot that may be assembled from five individual lion-like vehicles. Each of the vehicles has a hollow body with an openable portion for receiving a toy figure within the body and a pivotal head. Four legs are attached to the body for pivotal movement from an extended position in which the body is supportable on a surface to a retracted position. In addition, each body has an elongated tail mounted for pivotal movement relative to the body. One of the lion-like vehicles forms the torso of the composite toy robot and the limbs of this vehicle are substantially within a respective hip or shoulder joint in the retracted position. The tail of each of the arm and leg forming vehicles has a notch adjacent the end that is received in the hip or shoulder joint of the torso vehicle so that pivotal movement of the respective leg of the torso vehicle into the retracted position retains the tail. Each of the legs of the torso vehicle has an exposed side with an indentation to facilitate moving the legs back out of the retracted tail locking position.

13 Claims, 11 Drawing Figures

COMPOSITE TOY VEHICLE ASSEMBLY

BACKGROUND OF THE INVENTION

1. Field of the Invention

This invention relates generally to articulated toy figures and vehicles and more particularly to a toy robot that is a composite of a number of articulated toy vehicle assemblies.

2. Background of the Invention

Toys that are a composite of individual separate smaller toys or are reconfigurable into a different appearing toy are popular playthings. For example, U.S. Pat. Nos. 4,170,840; 4,391,060 and 4,411,097, respectively, disclose: an articulated figure of which subcomponents, together with other parts, are capable of forming a vehicle; three independent toy vehicles that can be reconfigured to simulate a robot; and a toy figure of which the head arm and legs are capable of being fully accommodated within the trunk. In addition, there are presently on the market a number of reconfigurable toys such as the HASBRO TRANSFORMERS, TONKA GOBOTS and MATCHBOX VOLTRON I, II and III. However, there remains a need for additional separate independent toys, the individual identities of which are mergeable into a different composite toy.

SUMMARY OF THE INVENTION

The present invention is concerned with providing an articulated composite toy formed of a plurality of separate, independent, articulated toys each capable of receiving a toy figure. These and other objects and advantages of the invention are achieved by providing a composite toy having first, second and third assemblies with each of the assemblies having a hollow body and a head attached for pivotal movement relative to the body. There are also a plurality of limbs attached to the body for pivotal movement relative to the body from an extended position in which the body is supportable on the limbs to a retracted position. In addition, an elongated appendage is mounted on each body for pivotal movement relative to the body. On the first assembly, the retracted position for each leg is substantially within a respective joint that is mounted for pivotal movement relative to the body of the first assembly. The tail on the second and third assemblies is insertable into an opening in a joint on the first assembly adjacent a respective leg of the first assembly and is retained in the body of the first assembly by the respective leg of the first assembly being pivoted into the retracted position. A removable canopy provides access to the hollow interior of each body for insertion of a toy figure.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
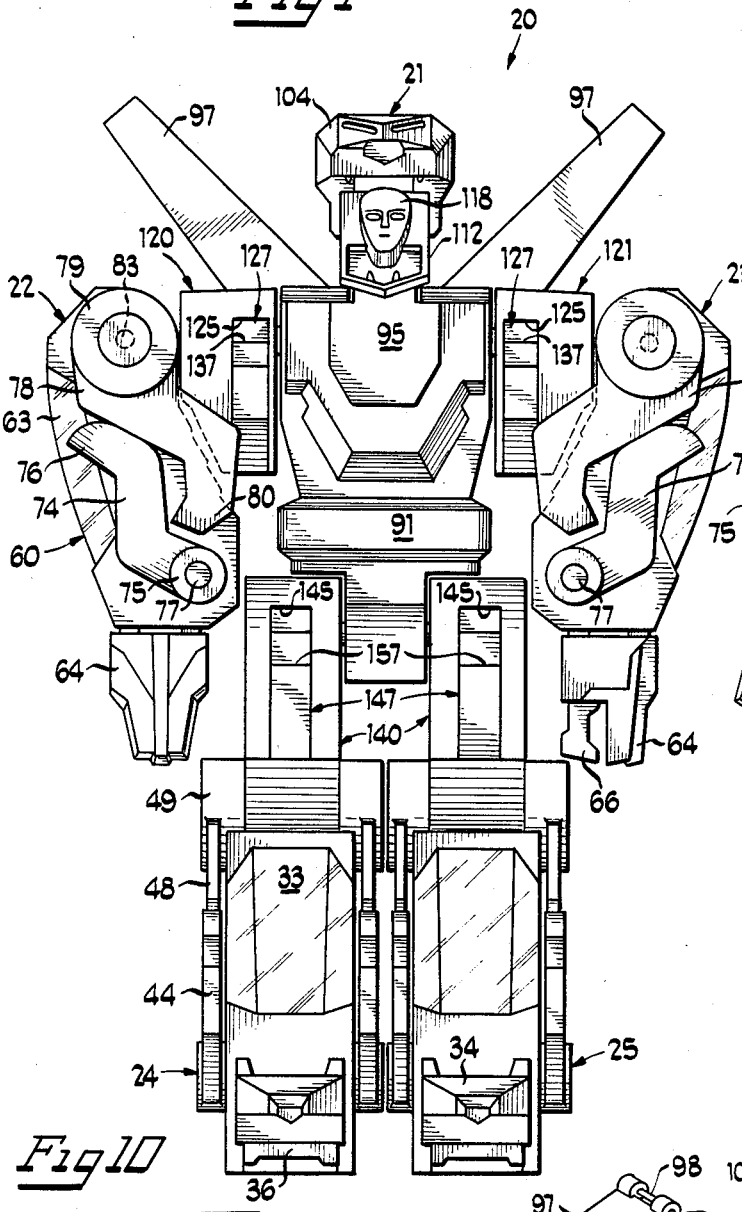
FIG. 1 is a front elevational view of a composite toy, embodying the present invention.

Referring now to the drawings in which like parts are designated by like reference numerals throughout the several views, there is shown in FIG. 1 a robotic composite toy 20 having a torso and head 21, right arm 22, left arm 23, right leg 24, and left leg 25. The first assembly forming a torso and head, the pair of second assemblies forming the arms, and the pair of third assemblies forming the legs are each separable to form a figure carrying, lion-like, toy vehicle.

Right and left leg assemblies 24 and 25 are basically similar but may be distinguished by surface orientation, attachments, indicia, and/or color. Each of the leg assemblies has a substantially hollow body 30 formed of mating shell halves 31 that are substantially mirror images of each other. Within the mating shell halves is a seat assembly 32 defining a cockpit area for receiving a toy figure in a seated position. Removably fitted over the cockpit area is a canopy 33, which is at least partially transparent to permit an inserted figure to be seen. A lion-like head 34 carries a pin 35 about which a lower jaw 36 pivots. The lower jaw is biased closed by a spring 37. Head 34 includes a neck drum 38 with inwardly recessed apertured end faces 39.

Figure 2:
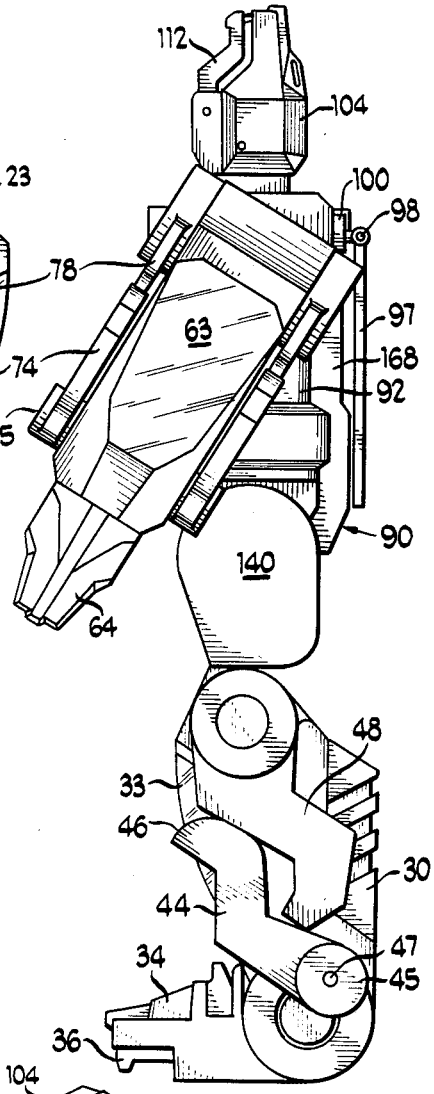
FIG. 2 is a side elevational view of the toy shown in FIG. 1 with some of the components rotated.

Drum 38 is mounted for rotational movement in a slot at the front of body 30 defined by inwardly directed, bored, bearing bosses 40 integrally formed on the inside of each mating shell 31, an upper back edge 41, and a lower belly edge 42. Movement of head 34 relative to body 30 should be at least ninety degrees and is preferably limited to about one hundred twenty degrees. Abutment of the head, or more particularly the back of the ears, with body 30 at edge 41, as shown in FIG. 2, establishes one limit and abutment of the bottom of the head with edge 42 of the drum receiving body opening establishes the other limit. A stepped pin 43 is press fitted into the aperture of a recessed drum end face and fits tight enough in the bore of the respective bearing boss to permit positioning of the head between the two limits. If desired, face ratchets could be used on the bearing boss and drum end recess to provide specific incremental positions. As another alternative, ratchet teeth could be provided on the cylindrical face of drum 38 that would be engaged by back edge 41 and/or belly edge 42 of the body opening to facilitate incremental positioning as well as provide sound during pivotal movement of the head.

Rearward of the axis of the neck drum mounting, a Z-shaped foreleg 44 having an apertured shoulder 45 adjacent one end and a paw 46 adjacent the other end is mounted for pivotal movement on a pin 47 integrally formed as part of each shell half 31. Adjacent the back end of the body, a Z-shaped hind leg 48 is mounted on either side. Hind leg 48 has an apertured shoulder 49 at one end and a paw 50 at the other end. An apertured boss on each body shell receives a stub shaft 53 that is inserted from the outside through the apertured shoulder 49 extending into the interior of body 30. At the rear of the body 30, a slot with an upper edge 54 and a lower edge 55 is formed along the parting line of the two shell halves. Extending out through the slot is an elongated curved tail 56. The inside end of the tail is integrally formed with a transverse mounting sleeve 57. Stub shafts 53 fit into either end of sleeve 57 to mount tail 56 for pivotal movement within the limits of upper and lower edges 54 and 55, respectively. Tail 56 has a notched barb 58 at the outer end and an upward projection 59 on the upper edge intermediate the barb and sleeve ends. As an alternative, each shell 31 may be formed with aligned pins projecting outwardly and inwardly from each side for respective mounting of hind legs 48 and tail 56 on a common axis.

Figures 3, 4, 5, 6, 7, 8, 9:
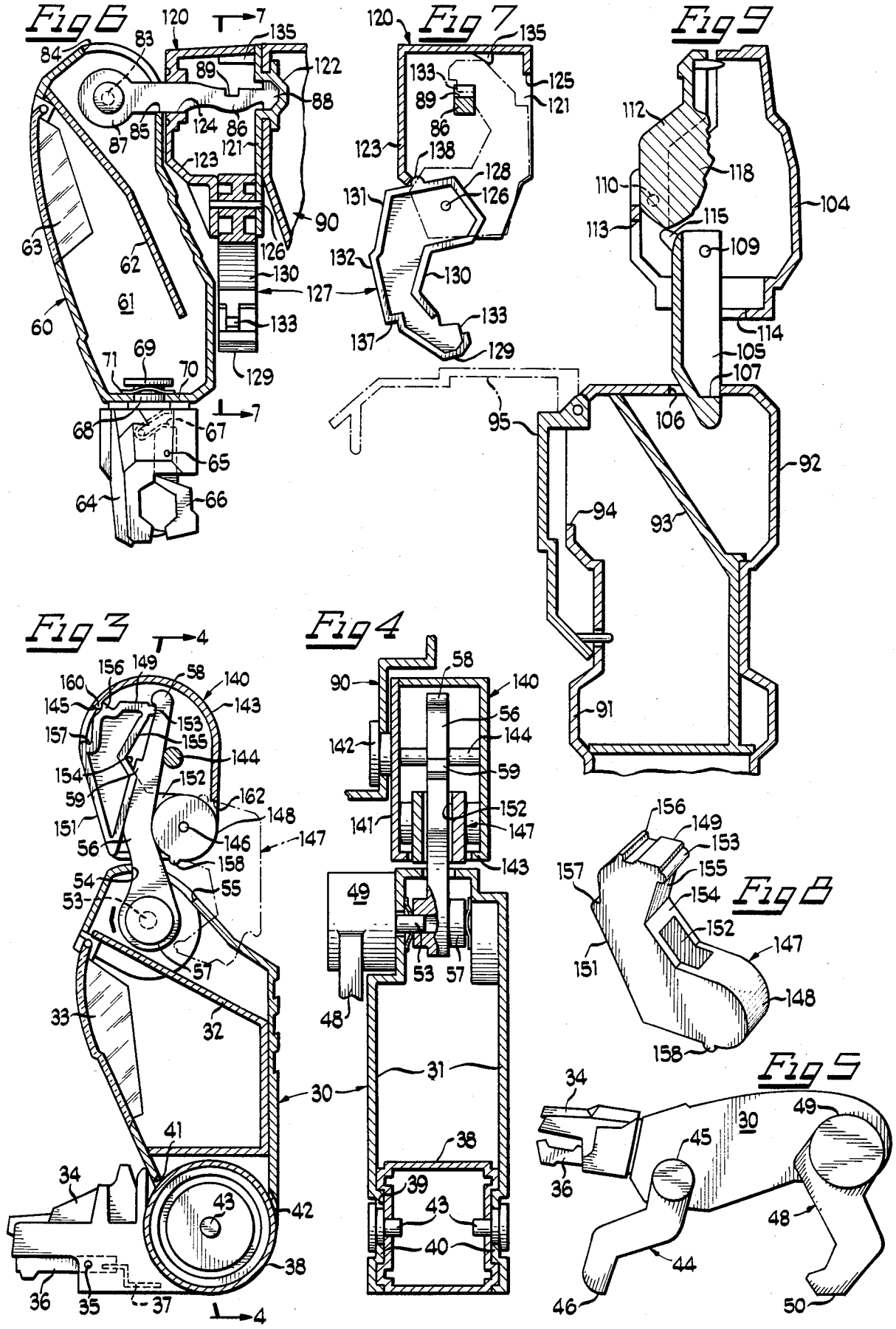
FIG. 3 is an enlarged scale, vertical sectional view taken through one of the leg assemblies.
FIG. 4 is a sectional view taken generally along line 4—4 of FIG. 3.
FIG. 5 is a side elevational view of one of the leg assemblies separated and standing.
FIG. 6 is an enlarged scale, vertical sectional view taken through one of the arm assemblies.
FIG. 7 is a sectional view taken generally along line 7—7 of FIG. 6.
FIG. 8 is an enlarged scale, perspective view of a hind leg of the torso and head assembly.
FIG. 9 is an enlarged scale, partial vertical sectional view of the torso and head assembly.

Both the forelegs 44 and the hind legs 48 are mounted for pivotal movement. As is illustrated in FIG. 5, the forelegs and hind legs are pivotably positionable to an extended position in which the legs support the body 30 spaced from a generally planar playing surface. The legs may also be pivoted to a retracted position in which the foreleg and hind leg on each side nest together along the side of the body. Both the forelegs and hind legs may be positioned, and retained by friction, in a variety of positions enabling posing of the lion-like vehicle assembly in an indefinite number of positions.

Similar to the leg assemblies, the right and left arm assemblies 22 and 23, respectively, have a generally hollow body 60 formed of mating, mirror image shell halves 61. A seat 62 is inserted into the hollow body portion to receive a toy figure and an at least partially transparent canopy 63 is removably fitted over the cockpit area defined by seat insert 62. At the front of each of the arm assembly bodies is a head 64 mounted for rotation about an axis generally parallel to the length of the body. Head 64 carries a pin 65 substantially transverse to the axis of rotation with a lower jaw 66 mounted on the pin for pivotal movement between an open and closed mouth position. A spring 67 biases the lower jaw into the closed mouth position. An annular neck groove 68 is formed adjacent the back end of the head which is defined by a collar 69. Body shell halves 61 form an inwardly directed flange 70 that fits into the neck groove 68 mounting the head for rotation relative to the body. A spring disc 71 positioned between flange 70 and collar 69 increases the friction between the head and body so that the head may be retained in a selected rotational position. Face ratchets, or detents may be used between the flange and collar instead of spring disc 71.

Rearward of head 64 a Z-shaped pair of forelegs 74 are mounted on the body for rotation about an axis substantially transverse to the rotational axis of the head. Each of the forelegs has an apertured shoulder 75 at one end and a paw 76 at the other end. Outwardly extending rods 77 integrally molded with each of the body shell halves 61 fit into the shoulder apertures. Z-shaped hind legs 78, similar to the hind legs 48 of the composite robot leg assemblies, each have an apertured shoulder 79 at one end and a paw 80 at the other end. Each of the shell halves 61 is provided with an aperture in which a stub shaft 83, after first passing through the apertured shoulder 79 in a respective hind leg, is inserted. The body shell halves define an elongated rear slot with upper and lower edges 84 and 85, respectively.

A curved tail 86 extends through the slot for pivotal movement between the edges. The inside end of the curved tail has a transverse mounting sleeve 87. Each of the stub shafts 83 are inserted into one end of the sleeve 87 to mount the tail 86 for pivotal movement about the same axis that the hind legs pivot. The free end of the curved tail is provided with a barbed tip 88 and there is a notch 89 on the upper edge of the tail. As with the leg assemblies, each shell 61 may alternatively be provided with aligned pins projecting outwardly and inwardly for respective mounting of hind legs 78 and tail 86 on a common axis.

Figure 11:
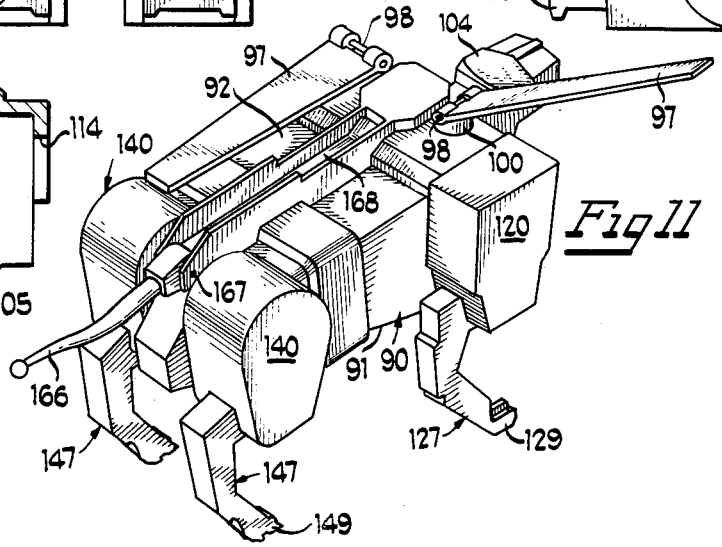
FIG. 11 is a perspective view of the torso and head assembly separated and standing.

Torso and head assembly 21 has a body 90 formed of a mating chest shell 91 and back shell 92. Within the generally hollow interior between the chest and back shells is a seat insert 93. The chest shell is provided with an opening 94 and a canopy 95 mounted for pivotal movement toward and away from the opening permitting insertion of a toy figure into the body of the torso and head assembly. Mounted on the back shell are a pair of wings 97 each of which is hinged by means of a pin 98 to a flanged mounting post 100. Each post is attached to the back shell for rotation about the axis of the respective post such as by inserting the post into an aperture on the back of the shell and securing it with a push nut (not shown). Thus, each wing 97 may be pivoted from a position flat against the back as shown in FIG. 2 to an upraised position as shown for one of the wings in FIG. 11 and may also be rotated to display the wings at various angles to body 90.

Mounted on body 90 to pivot out, through approximately ninety degrees, with respect to the body is a head 104. A sliding, extendable, channel neck 105 is carried by body 90 for in and out sliding movement through a C-shaped opening 106 in the top or front of body 90. The inside end of the neck 105 has a stop 107 that limits the outward sliding movement of the neck. At the other end of neck 105, head 104 is mounted for pivotal movement about a pin 109 carried by the neck. Head 104 bears a pin 110, generally parallel to pin 109. A lower jaw 112 is carried for pivotal movement about the axis of pin 110. There is a slot in the bottom and back of head 104 extending from an edge 113 behind the lower jaw to an edge 114 at the back of the head. Pivotal movement of the head with respect to the neck is limited to approximately ninety degrees from edge 113 to edge 114. Lower jaw 112 also pivots approximately ninety degrees from a mouth closed position to a mouth open position in which the lower jaw 112 is disposed generally parallel to the extended neck 105. The lower jaw will pivot beyond the position shown in FIG. 10, upon further extension of neck 105.

Figure 10:
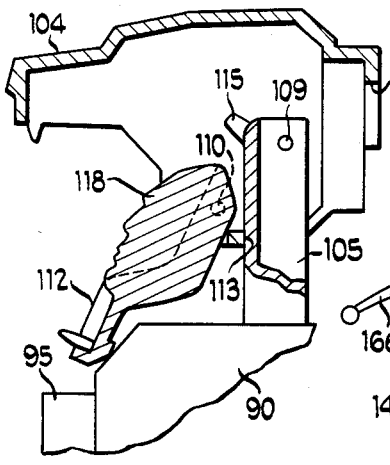
FIG. 10 is a sectional view similar to FIG. 9 but showing parts rotated.

Generally, when assembly 21 is in the separate lion-like vehicle stage, head 104 is aligned with the length of body 90 as illustrated in FIGS. 2 and 9. Once the assemblies are put together to form the composite toy robot 20, head 104 is pivoted approximately ninety degrees to face forward from the chest or front of the robot as illustrated in FIG. 10. When the neck is fully extended, head 104 is positioned as illustrated in FIG. 1. Upon rotating head 104 down to the forward facing robot position, an angled cam projection 115 near the top of the neck engages the back wall of lower jaw 112 camming the lower jaw to also pivot downwardly in a counterclockwise rotation. As the head is rotated forwardly and the neck fully extended, a face 118 on the inside of jaw member 112 is exposed to face forwardly.

On either side of body 90, adjacent the head end, a foreleg shoulder joint 120 is mounted for pivotal movement. Joint part 120 has an inside plate 121 with a laterally extending hollow flange trunnion 122. An outer cover plate 123 has a rectangular slot 124 that is substantially aligned with the hollow trunnion 122 when the cover and plate are secured together by adhesives, ultrasonic welding or other conventional fastening methods. Trunnion 122 is trapped for rotation by generally semicircular indentations along the parting lines of the inside plate 121 and outer cover plate 123. Spanning an opening 125 in shoulder 120, spaced from, but generally parallel to, an axis defined between the slot and the hollow trunnion is a pin 126. A foreleg 127 is mounted for pivotal movement in opening 125 adjacent one end 128 about pin 126. The opposed free end of the leg forms a paw 129. Between the paw and the mounted end there is an inward side 130 and an outward side 131. A flange 132 extends about the entire periphery of the leg except for at the intersection 133 of the paw end and the inward side.

On the inside of the upper wall of the cover plate forming the foreleg shoulder joint there is an inside shoulder detent or cam 135. Once leg 127 is pivoted into the retracted position inside of shoulder 120, the intersection of the paw end with the outward side of the leg engages the cam to retain the leg in the retracted position inside shoulder 120. Facilitating moving the leg 127 out of the retracted position is an indentation 137, more proximate the paw end than the attached end on outward side 131. A detent 138 is provided on the outward side adjacent the attached end. Detent 138 abuts the outer cover 123 to limit the pivotal extension of the leg to the position shown in FIG. 7. Between the extended limit and several intermediate positions, at which the leg is maintained in position by frictional engagement between the leg and the two plates forming the shoulder joint, leg 127 will, depending upon the position of the other legs, support body 90 spaced from a generally planar playing surface.

To form the arms of the composite toy robot 20, one of each of the assemblies forming the right arm 22 and the left arm 23 are attached by their respective tails 86 to one of the foreleg shoulder parts 120. For such assembly, the forelegs 74 and hind legs 78 of the arm assemblies 22 and 23 are rotated to the retracted positions shown in FIG. 1. Body 60 is then oriented with canopy 63 upward and tail 86 is inserted through slot 124 until the barbed tip 88 abuts the inside of hollow trunnion 122. Leg 127 is then pivoted to the retracted position inside of shoulder joint 120. As is best illustrated in phantom line in FIG. 7, when leg 127 is in the fully retracted position, the portion of the leg at intersection 133 which does not have a flange, fits into notch 89 in tail 86. Thus, tail 86 is supported at its free end and at an intermediate portion by the hollow trunnion and slot, respectively, and the retracted leg prevents removal of the tail through the slot while providing additional support of the portion of the tail adjacent the free end. The arm formed by assembly 22 or 23 may be pivoted downwardly and inwardly about the axis of the hind legs 78 and tail 86 to position the bottom or belly of body 60 adjacent the side of body 90. Arm 22 or 23 together with shoulder joint 120 may also be pivoted to the front and back of the robot about the axis of trunnion 122. Head 64 may be rotated when an arm assembly is attached to the torso and head assembly 21 with the biased closed mouth formed by head 64 and lower jaw 66; and functioning as a grasping hand.

Hind leg hip joints 140 are formed similar to the foreleg shoulder joints. Inside plate 141 has a laterally extending, flanged shaft 142 that is received for pivotable movement in generally semicircular indentations along the parting lines of the chest and back shells of body 90. An outer cover plate 143 is attached to inside plate 141. Extending between the inside plate and outer cover plate is a post 144 generally parallel to, but spaced from the axis of rotation of the hind leg hip 140. Extending across an opening 145 between the two plates forming the hip, spaced from and generally parallel to the axis of rotation, is a pin 146. A hind leg 147 is mounted on pin 146 for pivotal. movement between a retracted position inside hip 140 and extended positions supporting the body 90.

Opposite the rounded attached end 148 of leg 147 is a paw 149. Extending between the paw and the attached end are an inward side 150 and an outward side 151. Hind leg 147 is thicker than foreleg 127 and has a slot 152 extending through the leg from the inward side to the outward side intermediate the paw and rounded attached end. Inward side 150 has angled surfaces 154 and 155 between the slot and the paw end. At the intersection of the inward side and the paw end there is a raised toe ridge 153. The intersection of the paw and the outward side has a cam surface 156. Along outward side 151, closer to the paw than the rounded attached end, is an indentation 157. Adjacent the rounded end is a detent or raised rib 158.

For attachment of the right leg 24 and left leg 25 assemblies to the head and torso assembly 21, the respective forelegs and hind legs are rotated to nest alongside body 30 as illustrated in FIGS. 2. Hind leg 147 is then pivoted toward, but not all the way into the fully retracted position within hind leg hip joint 140. Curved tail 56 is then inserted through slot 152 and hind leg 147 is pushed into the fully retracted position. Tail 56 is thus trapped within part 140 by: engagement of toe ridge 153 with the notch of barb 58; the lower edge of the tail bearing against post 144; abutment of angled surfaces 154 and 155 of the hind leg with and the upper edge of curved tail 56 projection 59, respectively; plus the bearing of the rounded attached end 148 of the hind leg on the lower edge of curved tail 56. Either prior to or after attaching the leg assembly to hip joint 140, head 34 is pivoted to form the foot as illustrated in FIGS. 1, 2 and 3.

Hind leg 147 is secured in the fully retracted position within hip joint part 140 by the cam surface 156 engaging edge 160 forming the top of opening 145. A user's finger may be inserted into indentation 157 to facilitate pulling leg 147 out of the retracted position to an extended body supporting position. Detent 158 abuts against the inside of the lower edge 162 of opening 145 to define the most fully extended position.

In order to facilitate pivotal positioning of any of the legs with respect to the body and also the pivotal positioning of the tail of any of the arm and leg assemblies, opposing face ratchets may be provided on respective stationary and pivoting surfaces. Such face ratchets would provide a more positive pivotal position retention means than plain frictional engagement.

Although not required in the attachment of the assemblies, torso and head assembly 21 is also provided with a tail 166 that is mounted for pivotal movement on back shell 92 by means of pin 167. When the composite toy robot is formed the tail is pivoted from an extended position generally aligned with the length of body 90 to a retracted position still aligned with the length of the body but lying adjacent the back in channel 168.

While a particular embodiment of the present invention has been shown and described with some changes and modifications, further such changes and modifications will occur to those skilled in the art. It is intended in the appended claims to cover all such changes and modifications as fall within the true spirit and scope of the present invention.

What is claimed as new and desired to be secured by Letters Patent is:

1. A composite toy comprising:

first, second and third assemblies;

each of the assemblies having a body with a head attached for pivotal movement relative to the body;

a plurality of limbs attached to each body for pivotal movement relative to the body from an extended position in which the body is supportable on the limbs to a retracted position;

the retracted position for the limbs on the first assembly being substantially within a part of the first assembly;

an elongated appendage mounted on each body of the second and third assemblies for pivotal movement relative to the body; and the elongated appendage of each of the second and third assemblies being insertable into the part of the first assembly adjacent a respective limb of the first assembly and being retained within the part of the first assembly by the respective limb of the first assembly being pivoted into the retracted position.

2. The composite toy of claim 1 in which the limbs are legs and the part is a hip or shoulder joint that is also mounted for pivotal movement relative to the body of the first assembly.

3. The composite toy of claim 1 in which:

the elongated appendages of the second and third assemblies have a mounted end and an opposed free end with a notch adjacent the free end;

the limbs of the first assembly have a pivotally attached end and an opposed support end as well as an inward side and an outward side relative to the body of the first assembly in the retracted position;

the intersection of the support end and the inward side of a respective limb of the first assembly engaging the notch to retain the elongated appendage substantially in a predetermined relationship within the part of the first assembly.

4. The composite toy of claim 3 in which the outward side of the limbs of the first assembly have an indentation facilitating manual grasping of the limb to pivot it out of the retracted position.

5. The composite toy of claim 3 in which means inside the part support a portion of the appendage intermediate the mounted end and the free end.

6. The composite toy of claim 5 in which engagement of the intersection with the notch urges the intermediate portion of the appendage against the means inside the part.

7. The composite toy of claim 5 in which additional means inside the part into which the appendage of the second assembly is insertable support the free end.

8. The composite toy of claim 1 in which there are a pair of the second assemblies and a pair of the third assemblies.

9. The composite toy of claim 8 in which the second assemblies form arms for the composite toy and the third assemblies form legs for the composite toy while the first assembly forms the head and torso for the composite toy.

10. The composite toy of claim 1 in which the body of each assembly has a hollow cockpit portion capable of receiving a toy figure.

11. The composite toy of claim 10 in which each assembly has an openable canopy providing access to the cockpit for insertion and removal of the figure.

12. The composite toy of claim 11 in which at least some of the canopies are at least partially transparent.

13. The composite toy of claim 1 including means for maintaining the limbs at a number of pivotal positions between the extended position and the retracted position.

* * * * *